US006422385B1

(12) United States Patent
Smith

(10) Patent No.: US 6,422,385 B1
(45) Date of Patent: Jul. 23, 2002

(54) ELASTIC SKI COVERING HAVING REMOVABLE FASTENERS

(76) Inventor: Joseph Stork Smith, 201 W. Greyhound Pass, Carmel, IN (US) 46032

( * ) Notice: Subject to any disclaimer, the term of this patent is extended or adjusted under 35 U.S.C. 154(b) by 0 days.

(21) Appl. No.: 09/177,312

(22) Filed: Oct. 22, 1998

(51) Int. Cl.[7] ..... B65D 85/20
(52) U.S. Cl. ..... 206/315.1; 53/467; 280/814
(58) Field of Search ..... 206/315.1; 53/467, 53/469, 473, 441; 150/154; 280/814–816

(56) References Cited

U.S. PATENT DOCUMENTS

| | | | | | |
|---|---|---|---|---|---|
| 2,180,686 | A | * | 11/1939 | Lorinovich | 206/315.1 |
| 3,336,961 | A | * | 8/1967 | Welsh | 206/315.1 |
| 3,851,689 | A | | 12/1974 | Kohls | |
| 3,896,981 | A | | 7/1975 | Purple | |
| 4,055,287 | A | | 10/1977 | Champenois, Jr. | |
| 4,161,268 | A | * | 7/1979 | Heil | 206/315.1 |
| 4,191,233 | A | | 3/1980 | McKay | |
| 4,196,762 | A | | 4/1980 | Goodwin et al. | |
| 4,377,306 | A | | 3/1983 | Abatecola | |
| 4,402,355 | A | * | 9/1983 | Wymore et al. | 206/315.1 |
| 4,483,380 | A | * | 11/1984 | Beran | 206/315.1 |
| 4,644,986 | A | | 2/1987 | Fusaro | |
| 4,674,787 | A | | 6/1987 | DeVera | |
| 4,715,416 | A | | 12/1987 | Horne | |
| 4,815,509 | A | | 3/1989 | Owen | |
| 4,860,935 | A | * | 8/1989 | Paylinsky | 206/315.1 |
| 4,958,760 | A | | 9/1990 | Mulé et al. | |
| 5,012,921 | A | | 5/1991 | Becker | |
| 5,022,678 | A | | 6/1991 | Mayfield | |
| 5,104,017 | A | | 4/1992 | Vandagriff | |
| 5,163,550 | A | * | 11/1992 | Hawk | 206/315.1 |
| 5,207,323 | A | | 5/1993 | McConnell | |
| 5,310,221 | A | | 5/1994 | Schmidt | |
| 5,350,096 | A | | 9/1994 | Sieber | |
| 5,522,592 | A | | 6/1996 | Evelsizer, Jr. | |

* cited by examiner

*Primary Examiner*—Luan K. Bui
(74) *Attorney, Agent, or Firm*—Woodard, Emhardt, Naughton, Moriarty & McNett

(57) ABSTRACT

The present invention generally relates to an elastic ski covering having removable fasteners. In a preferred embodiment, the ski covering is made from a stretchable, washable, water-permeable, elastic material and is formed into an elongated tube, similar in configuration to a sock. A pair of skis, arranged bottom-to-bottom are inserted into the ski covering, which stretches to fit snuggly over the skis and their associated bindings. The length of the ski covering, in conjunction with its elastic nature, allow the ski covering to completely cover skis having a widely varying length. The open end of the ski covering includes integral straps for tying the end closed after the skis have been placed therein. A pair of removable fasteners are provided and are placed on either side of the ski bindings in order to securely affix the ski covering to the skis and to securely hold the skis against one another. The removable nature of these fasteners allows them to be placed next to the ski bindings, regardless of how far apart the binding components are fitted on the particular skis being covered.

22 Claims, 3 Drawing Sheets

ELASTIC SKI COVERING HAVING REMOVABLE FASTENERS

TECHNICAL FIELD OF THE INVENTION

The present invention generally relates to sporting equipment and, more particularly, to an elastic ski covering having removable fasteners.

BACKGROUND OF THE INVENTION

Snow skiing is a very popular sport, both in the United States and throughout the world. Because most people do not live at the locations where the terrain and weather are favorable for snow skiing, it is usually necessary for skiers to travel to a ski resort in order to engage in the sport. This, of necessity, requires that the skier transport his or her skis to this location.

Snow skis are high performance articles of sporting equipment, and are therefore usually relatively expensive. Furthermore, snow skis are also somewhat delicate, especially with regard to keeping their various surfaces and edges in optimal condition for skiing. It is therefore essential that the skis be protected from physical harm while they are being transported. It is believed by the inventor that all of the existing designs for protecting skis while being transported are inadequate for various reasons.

For example, U.S. Pat. No. 5,022,678 to Mayfield discloses a ski sleeve, which is designed to fit over the tip of a ski at either end. The ski sleeves have integral hook and loop fasteners which may be used to secure the ski sleeve to the ski. This design is undesirable in that it fits over only a single ski and leaves the bulk of that ski, as well as the other ski in the pair, completely unprotected. U.S. Pat. No. 4,055,287 to Champenois, Jr. discloses a protective covering for a snow ski binding which comprises a weather-proof sheet that is wrapped around the bindings of a pair of skis and then secured thereto by means of an integral hook and loop fastener. This design is undesirable because it also leaves a large expanse of the skis completely unprotected. U.S. Pat. No. 3,851,689 to Kohis discloses a foldable ski cover comprising an elongated bag having two compartments for receiving an individual ski in each compartment. The bag is made from a flexible, waterproof material and includes several reclosable fasteners attached thereto. It is believed that this design is also undesirable due to the fact that the waterproof material will tend to trap dirt and debris therein after use with dirty skis, wherein such debris can only be removed with difficulty. Furthermore, skis are manufactured and sold in widely varying lengths, and the positioning of the fasteners on this prior art bag may be awkward and therefore undesirable when used with certain ski lengths.

It is therefore an object of the present invention to provide a flexible ski bag which completely encloses the skis being transported in order to prevent damage to the skis.

It is another object of the present invention to provide a ski covering that is suitable for use with skis having varying lengths.

It is still another object of the present invention to provide a ski covering which has fasteners which may be adapted for optimal placement on skis of varying length.

It is yet another object of the present invention to provide a ski covering from which dirt and debris may easily be removed after use with dirty skis.

Other objects and advantages of the present invention will become apparent from the following written description and appended claims taken in conjunction with the accompanying drawings.

SUMMARY OF THE INVENTION

The present invention generally relates to an elastic ski covering having removable fasteners. In a preferred embodiment, The ski covering is made from a stretchable, washable, water-permeable, elastic material and is formed into an elongated tube, similar in configuration to a sock. A pair of skis, arranged bottom-to-bottom are inserted into the ski covering, which stretches to fit snuggly over the skis and their associated bindings. The length of the ski covering, in conjunction with its elastic nature, allow the ski covering to completely cover skis having a widely varying length. The open end of the ski covering includes integral straps for tying the end closed after the skis have been placed therein. A pair of removable fasteners are provided and are placed on either side of the ski bindings in order to securely affix the ski covering to the skis and to securely hold the skis against one another. The removable nature of these fasteners allows them to be placed next to the ski bindings, regardless of how far apart the binding components are fitted on the particular skis being covered.

In one form of the invention, a ski covering is disclosed, comprising a first rectangular material piece formed from a flexible, elastic, water-permeable fabric; a second rectangular material piece formed from the fabric; wherein the first and second material pieces are coupled together along three respective sides, thereby forming an opening at a fourth side; and a plurality of removable fasteners adapted to removably enclose the first and second material pieces and any contents placed therebetween.

In another form of the invention, a ski covering is disclosed, comprising an elongated material piece formed from a flexible, elastic, water-permeable fabric, the material piece having an opening and defining an interior cavity sized to accept a pair of skis therein; and at least one removable fastener adapted to removably enclose the material piece and any skis placed within the interior cavity.

In another form of the invention, a combination is disclosed, comprising an elongated material piece formed from a flexible, elastic water-permeable fabric, the material piece having an opening and defining an interior cavity therein; a pair of skis contained within the interior cavity; and at least one removable fastener firmly holding the skis in contact with one another.

In another form of the invention, a method of covering a pair of skis having bindings thereon is disclosed, comprising the steps of providing an elongated material piece formed from a flexible, elastic water-permeable fabric, the material piece having an opening, and an interior cavity therein; sliding the skis through the opening and into the interior cavity such that the skis are completely enclosed therein; closing the means for closing; providing at least one removable fastener adapted to removably enclose the skis; and applying the at least one removable fastener around the skis such that the skis are firmly held in contact with one another.

DETAILED DESCRIPTION OF THE PREFERRED EMBODIMENTS

Figure 1:
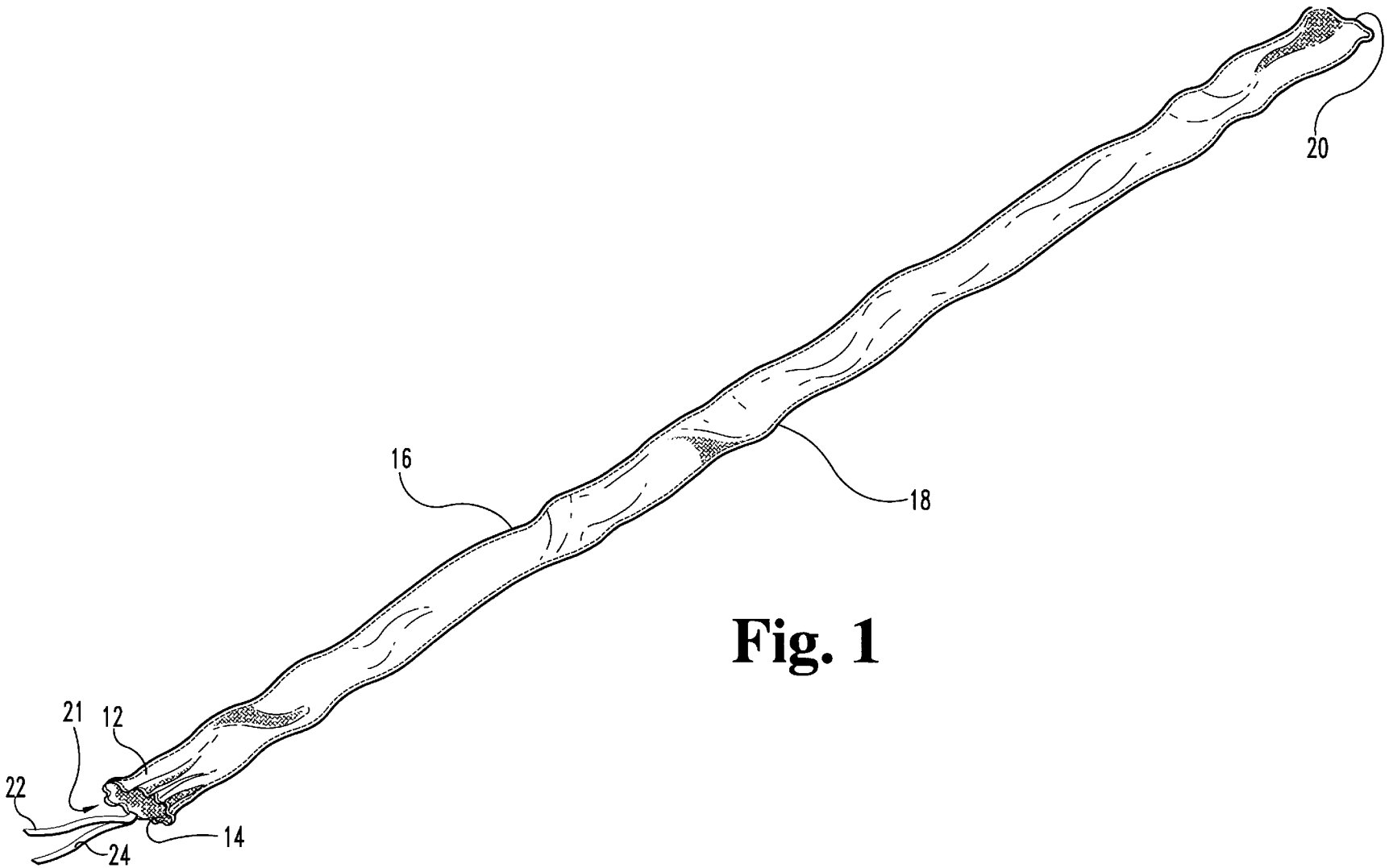
FIG. 1 is a perspective view of a preferred embodiment ski covering of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The preferred embodiment of the present invention comprises three components, namely an elastic ski covering and a pair of removable fasteners for use therewith. A preferred embodiment of the elastic covering of the present invention is illustrated in FIG. 1, and indicated generally at 10. The ski covering 10 is designed to cover any length skis up to at least about seven feet long using a single-size ski covering 10. The ski covering 10 is preferably formed a first piece of material 12 and a second piece of material 14, each having an elongated rectangular configuration approximately eight feet long and four inches wide, although shorter or longer material pieces will also work. The first material piece 12 is preferably sewn to the second material piece 14 along three edges, thereby forming seams 16, 18 and 20. The fourth side of the material pieces 12, 14 is left open, thereby defining an opening 21 into an interior cavity. The ski covering 10 is therefore formed as an elongated rectangular bag having an opening on one of the small sides.

In the preferred embodiment, the first material piece 12 and second material piece 14 are formed from a flexible, stretchable, elastic material, such as an elasticized nylon (or other synthetic fiber) weave. Other, alternative, materials are also contemplated for construction of the first material piece 12 and second material piece 14. For example, natural fibers such as cotton or wool may be used. It is desirable that the material construction chosen be washable and water-permeable, so that the ski covering 10 may be washed after use in order to remove any debris which may have become lodged therein, after stretching the ski covering 10 over a dirty pair of skis. In an alternative embodiment, the ski covering 10 may be formed from a continuously woven tube, such as those used in the manufacturer of socks, having the same approximate dimensions described hereinabove. In this alternative embodiment, the seams 16 and 18 (and possibly the seam 20) will be eliminated.

Figure 3:
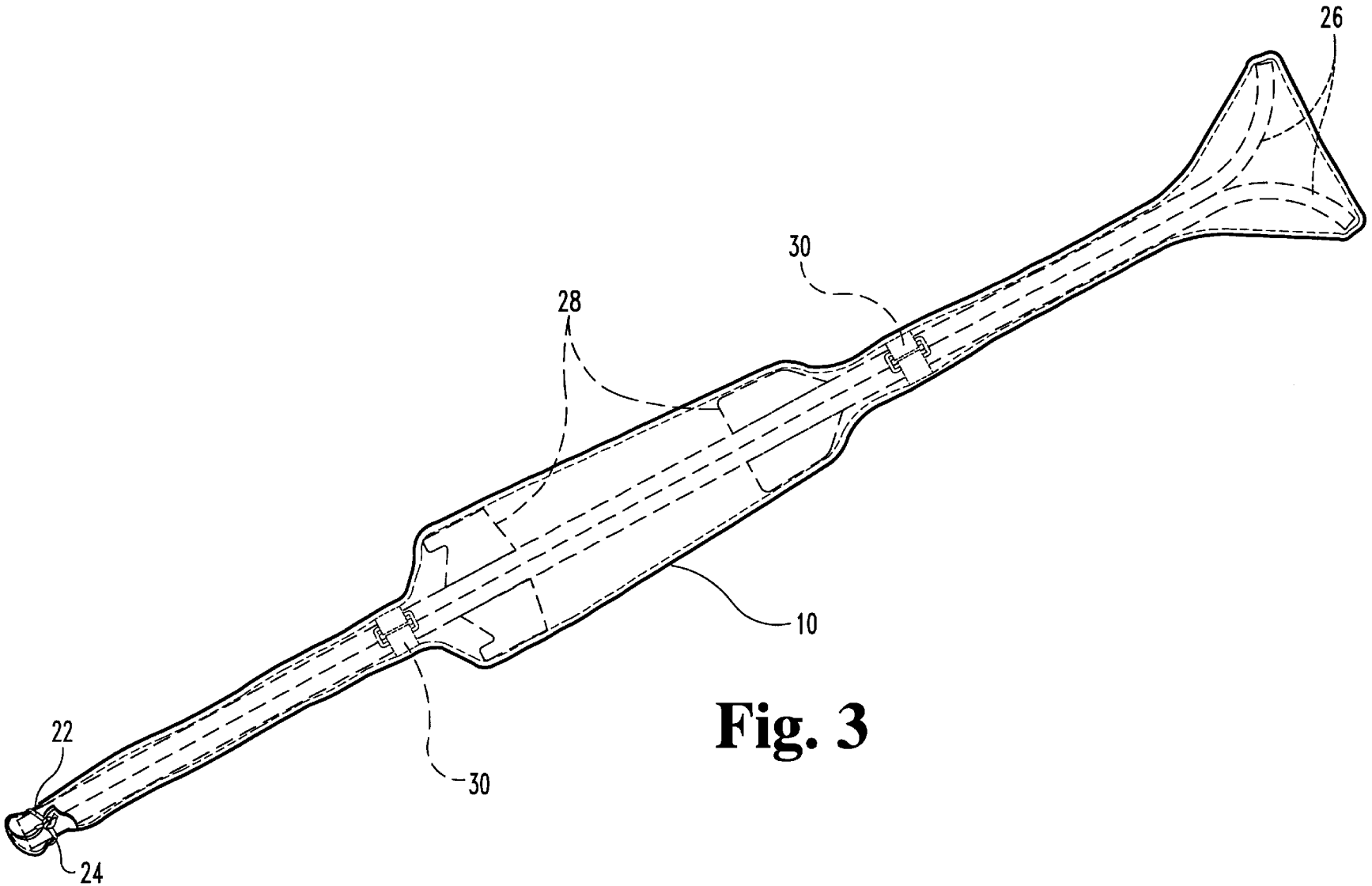
FIG. 3 is a side elevational view of the preferred embodiment ski covering and removable fasteners installed upon a pair of skis.

When configured as described hereinabove, the ski covering 10 may be slid over a pair of skis positioned bottom-to-bottom by placing the open end over the tips of the skis and pulling the ski covering to the other end of the skis, until the tips of the skis are located at the seam 20. As shown in FIG. 3, the stretchable, elastic nature of the fabric pieces 12, 14 allows the ski covering 10 to generally conform to the shape of the skis 26 and bindings 28. Because the length of the ski covering 10 is longer than the skis 26 for which it is designed to cover, a pair of end closure straps 22, 24 are sewn to the second material piece 14 near the opening 21. The end closure straps 22, 24 are preferably formed from a woven nylon or other strong material. The excess portion of the material pieces 12, 14 which extend beyond the end of the skis 26 is folded over upon itself and the end closure straps 22, 24 are wrapped therearound and tied into a knot. The end closure straps 22, 24 therefore prevent the skis 26 from exiting the opening 21 while the skis 26 are contained within the ski covering 10.

It will be appreciated by those skilled in that art that any conventional means for closing the opening 21 may be used in place of the end closure straps 22,24. For example, and not by way of limitation, the opening 21 may be closed using a zipper, a drawstring, a hook-and-loop closure, snaps, buttons, or any other conventional means for closing known in the art.

Figure 2:
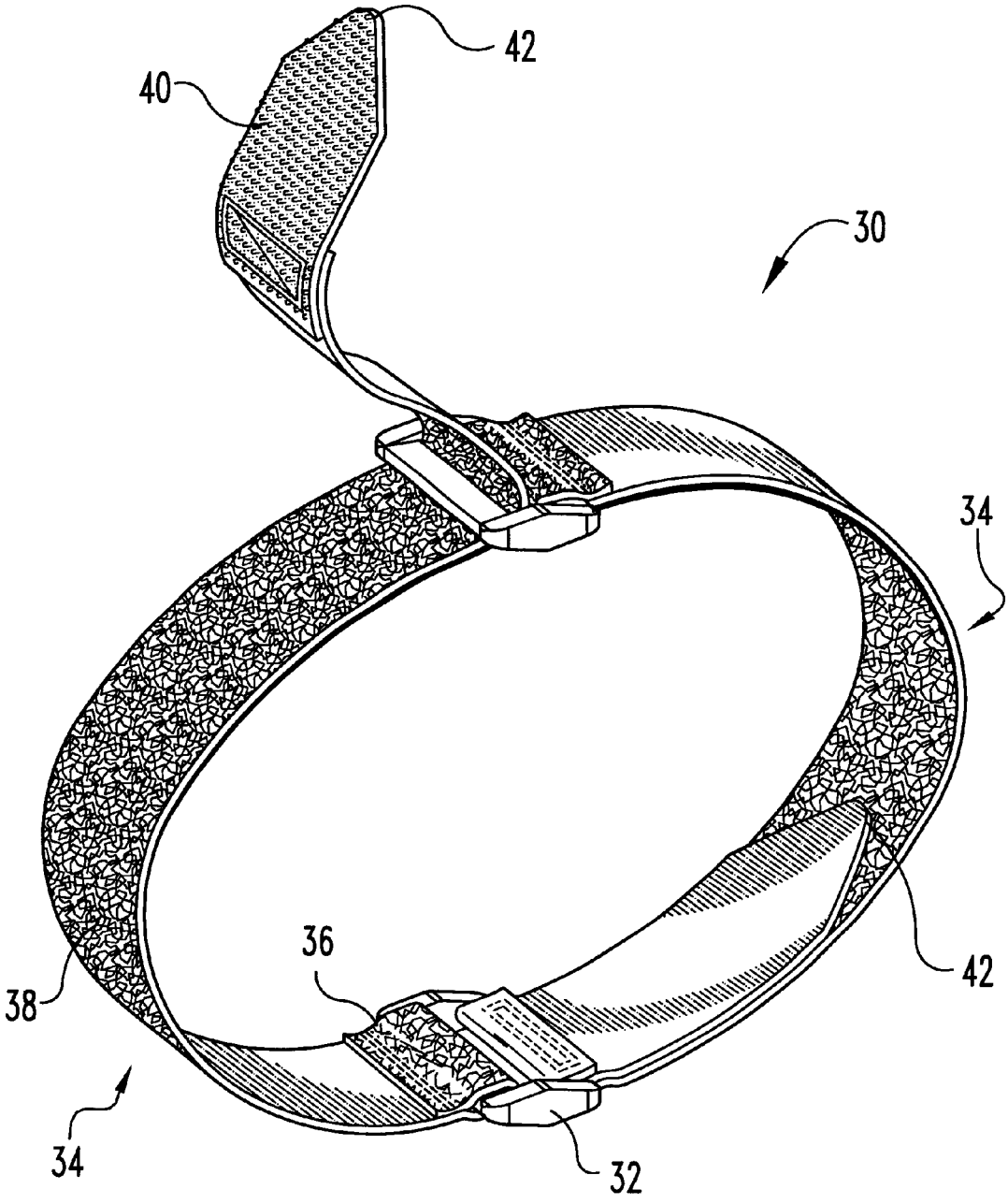
FIG. 2 is perspective view of a preferred embodiment removable fastener of the present invention.

As can be seen with reference to FIG. 3, the ski covering 10 of the present invention, because of its length and elastic nature, is able to completely cover and conform to fit skis 26 having any length and any size bindings 28. A single size configuration for the ski covering 10 therefore suffices to provide what appears to be a custom fit for any size ski 26/binding 28 combination. In order to maintain these skis 26 in their bottom-to-bottom configuration, and to more closely conform the ski covering 10 to the contours of the skis 26/bindings 28, a pair of removable fasteners are preferably provided as illustrated in FIG. 2 and indicated generally at 30. The removable fasteners 30 may be of any type which allow the fasteners 30 to hold the ski covering 10 and skis 26 firmly together at any point along their length, such that the fastener 30 is removable from the ski covering 10 in order to allow it to be placed at a different position along the length of the skis 26. In the preferred embodiment illustrated in FIG. 2, the removable fastener 30 comprises two rectangular plastic buckles 32 and two closure straps 34. The first end 36 of each closure strap 34 is wrapped around one side of a respective one of the buckles 32 and sewn to itself in order to form a permanent connection to the respective buckle 32, as shown.

Each of the straps 34 is preferably formed from an elastic woven nylon webbing or other strong material and includes a first portion 38 covered with loop pile material and a second portion 40 covered with hook material, thereby forming a hook-and-loop fastener pair. A second end 42 of each closure strap 34 may then be threaded through the remaining half of the opposite buckle 32 and closed by engaging the hook material 40 with the loop pile material 38 at a desired location.

As illustrated in FIG. 2, this arrangement provides for a removable fastener 30 which may be placed around objects having widely varying sizes and adjusted so as to tightly conform to a perimeter completely surrounding the objects.

The preferred embodiment removable fastener 30 is therefore ideally suited for use with the ski covering 10 of the present invention. As illustrated in FIG. 3, removable fasteners 30 are placed directly around the skis 26 at a location on either side of the bindings 28. Alternatively, the removable fasteners 30 may be placed over the exterior of ski covering 10, if desired. The removable fastener 30 may then be stretched to a size that securely holds the ski covering 10 and skis 26 together, at which point the removable fastener 30 may be closed by engaging the hook material 40 to the loop pile material 38. Once engaged on either side of the bindings 28, the removable fasteners 30 function to maintain the skis 26 in a bottom-to-bottom configuration. Additionally, placement of the removable fasteners 30 over the exterior of the ski covering 10 will also limit movement of the skis 26 bindings 28 within the ski covering 10, reducing any detrimental rubbing between the ski covering 10 and the skis 26 and will also prevent the skis 26 from sliding down and applying pressure upon the knot tied with the end closure. straps 22, 24 and possibly forcing this knot open. Because the fasteners 30 are completely removable from the skis 26 and the ski covering 10, they may be placed at any point along the length thereof, greatly facilitating the use of the ski covering 10 with bindings 28 of widely varying dimensions and allowing the fasteners 30 to be placed as close as desirable to the bindings 28. The ski covering 10 and removable fasteners 30 of the present invention therefore provide a ski covering that may be custom fit to any ski 26/binding 28 combination. The stretchable elastic fabric of the ski covering 10 will conform to the contours of the skis 26/bindings 28, the end closure straps 22, 24 may be tied off at the end of any length ski 26, and the removable fasteners 30 may be used to tightly couple the whole combination together on either side of the bindings 28. The washable, water permeable weave of the material 12, 14 allows the ski covering 10 to be washed after use and any debris lodged therein completely removed prior to the next use of the ski covering 10. The ski covering of the present invention therefore represents a significant improvement over the prior art devices.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What claimed is:

1. A ski covering, comprising:

a first rectangular material piece formed from a flexible, elastic, waterpermeable fabric;

a second rectangular material piece formed from the fabric;

wherein the first and second material pieces are coupled together along three respective sides, thereby forming an opening at a fourth side and a cavity therein; and wherein the first and second material pieces are sized to allow a pair of skis oriented bottom-to-bottom to be substantially form-fittingly placed within the cavity; and a plurality of removable fasteners adapted to removably enclose the first and second material pieces and any contents placed therebetween.

2. The ski covering of claim 1, further comprising at least one end closure strap coupled to the second material piece at the fourth side.

3. The ski covering of claim 1, wherein the fabric comprises a woven synthetic fiber.

4. The ski covering of claim 1, wherein said first and second material pieces are of a length that will cover any ski up to at least about seven feet long.

5. The ski covering of claim 4, wherein said first and second material pieces are approximately eight feet long and four inches wide.

6. The ski covering of claim 2, wherein the at least one end closure strap comprises two woven nylon elastic straps.

7. A ski covering, comprising:

a first rectangular material piece formed from a flexible, elastic, water-permeable fabric;

a second rectangular material piece formed from the fabric;

wherein the first and second material pieces are coupled together along three respective sides, thereby forming an opening at a fourth side; and a plurality of removable fasteners adapted to removably enclose the first and second material pieces and any contents placed therebetween;

wherein each of said plurality of removable fasteners comprises:

a first buckle;

a second buckle;

a first elastic strap having a first end and a second end, wherein the first end is coupled to one side of the first buckle;

a first hook material applied to the first strap at the second end;

a first loop pile material applied to the first strap between the first and second ends;

a second elastic strap having a third end and a fourth end, wherein the third end is coupled to one side of the second buckle;

a second hook material applied to the second strap at the fourth end; and a second loop pile material applied to the second strap between the third and fourth ends; whereby the second end may be adjustably engaged around another side of the second buckle and the first hook material engaged with the first loop pile material; and whereby the fourth end may be adjustably engaged around another side of the first buckle and the second hook material engaged with the second loop pile material.

8. A ski covering, comprising:

an elongated material piece formed from a flexible, elastic, water-permeable fabric, the material piece having an opening and defining an interior cavity sized to accept a pair of skis therein; and at least one removable fastener adapted to removably enclose the material piece and any skis placed within the interior cavity;

wherein the elongated material piece is sized to allow a pair of skis oriented bottom-to-bottom to be placed within the interior cavity and wherein the interior cavity substantially form-fittingly encloses the pair of skis.

9. The ski covering of claim 8, further comprising means for closing the opening.

10. The ski covering of claim 8, wherein the fabric comprises a woven synthetic.

11. The ski covering of claim 8, wherein said material piece is of a length that will cover any ski up to at least seven feet long.

12. The ski covering of claim 11, wherein the material piece is approximately eight feet long and four inches wide when flat.

13. The ski covering of claim 9, wherein the means for closing comprises two woven nylon straps coupled to the material piece at the opening.

14. A ski covering, comprising:

an elongated material piece formed from a flexible, elastic, water-permeable fabric, the material piece having an opening and defining an interior cavity sized to accept a pair of skis therein; and at least one removable fastener adapted to removably enclose the material piece and any skis placed within the interior cavity;

wherein the at least one removable fastener comprises a first buckle;

a second buckle;

a first elastic strap having a first end and a second end, wherein the first end is coupled to one side of the first buckle;

a first hook material applied to the first strap at the second end;

a first loop pile material applied to the first strap between the first and second ends;

a second elastic strap having a third end and a fourth end, wherein the third end is coupled to one side of the second buckle;

a second hook material applied to the second strap at the fourth end; and a second loop pile material applied to the second strap between the third and fourth ends;

whereby the second end may be adjustably engaged around another side of the second buckle and the first hook material engaged with the first loop pile material; and whereby the fourth end may be adjustably engaged around another side of the first buckle and the second hook material engaged with the second loop pile material.

15. A combination, comprising:

an elongated material piece formed from a flexible, elastic, waterpermeable fabric, the material piece having an opening and defining an interior cavity therein;

a pair of skis oriented bottom-to-bottom and contained within the interior cavity; and at least one removable fastener firmly holding the skis in contact with one another;

wherein the elongated material piece substantially form-fittingly encloses the pair of skis and the at least one removable fastener.

16. The combination of claim 15, further comprising means for closing the opening.

17. The combination of claim 15, wherein the fabric comprises a woven synthetic.

18. The combination of claim 16, wherein the means for closing comprises two woven nylon straps coupled to the material piece at the opening.

19. A combination, comprising:

an elongated material piece formed from a flexible, elastic, water-permeable fabric, the material piece having an opening and defining an interior cavity therein;

a pair of skis contained within the interior cavity; and at least one removable fastener firmly holding the skis in contact with one another;

wherein the at least one removable fastener comprises a first buckle;

a second buckle;

a first elastic strap having a first end and a second end, wherein the first end is coupled to one side of the first buckle;

a first hook material applied to the first strap at the second end;

a first loop pile material applied to the first strap between the first and second ends;

a second elastic strap having a third end and a fourth end, wherein the third end is coupled to one side of the second buckle;

a second hook material applied to the second strap at the fourth end; and a second loop pile material applied to the second strap between the third and fourth ends;

whereby the second end may be adjustably engaged around another side of the second buckle and the first hook material engaged with the first loop pile material; and whereby the fourth end may be adjustably engaged around another side of the first buckle and the second hook material engaged with the second loop pile material.

20. A method of covering a pair of skis having bindings thereon, comprising the steps of:

a) providing an elongated material piece formed from a flexible, elastic, water-permeable fabric, the material piece of having an opening, means for closing the opening, and an interior cavity therein sized to allow a pair of skis oriented bottom-to-bottom to be placed within the interior cavity;

b) sliding the skis through the opening and into the interior cavity such that the skis are oriented bottom-to-bottom and are completely enclosed therein;

c) closing the means for closing to form-fittingly enclose the skis within the elongated material piece;

d) providing at least one removable fastener adapted to removably enclose the skis; and e) applying the at least one removable fastener around the skis such that the skis are firmly held in contact with one another.

21. The method of claim 20, wherein step (c) further comprises:

c.1) providing a pair of woven nylon straps, each of the straps being coupled at one end to the opening;

c.2) folding over an end of the material piece containing the opening, thereby closing the opening;

c.3) wrapping the nylon straps around the folded-over end of the material; and c.4) tying the nylon straps into a knot.

22. The method of claim 20, wherein the skis further include bindings connected respectively thereto and wherein steps (d) and (e) further comprise:

d) providing a first and second removable fastener, wherein each removable fastener is adapted to removably enclose the material piece and the skis; and e.1) applying the first removable fastener at a first location on one side of the bindings, such that the material piece and the skis are firmly held in contact with one another at the first location; and e.1) applying the second removable fastener at a second location on another side of the bindings, such that the material piece and the skis are firmly held in contact with one another at the second location.

* * * * *